US012151144B1

(12) United States Patent
Reed et al.

(10) Patent No.: US 12,151,144 B1
(45) Date of Patent: Nov. 26, 2024

(54) GOLF CLUB HEAD WITH HOLLOW STRESS-REDUCING FEATURES

(71) Applicant: Topgolf Callaway Brands Corp., Carlsbad, CA (US)

(72) Inventors: Nathan Reed, San Diego, CA (US); James A. Seluga, Carlsbad, CA (US); Denver Holt, Carlsbad, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 0 days.

(21) Appl. No.: 18/208,465

(22) Filed: Jun. 12, 2023

Related U.S. Application Data

(63) Continuation of application No. 17/475,185, filed on Sep. 14, 2021, now abandoned.

(60) Provisional application No. 63/232,595, filed on Aug. 12, 2021.

(51) Int. Cl.
*A63B 53/04* (2015.01)

(52) U.S. Cl.
CPC ..... *A63B 53/0416* (2020.08); *A63B 53/0408* (2020.08); *A63B 53/0437* (2020.08); *A63B 53/0466* (2013.01)

(58) Field of Classification Search
CPC ..... A63B 53/0433; A63B 53/0408; A63B 53/0416; A63B 53/0487; A63B 2053/0491; A63B 53/0466; A63B 53/0475
See application file for complete search history.

(56) References Cited

U.S. PATENT DOCUMENTS 5,255,918 A * 10/1993 Anderson ..... A63B 60/00 473/330
5,346,219 A * 9/1994 Pehoski ..... A63B 53/0487 473/340
5,499,814 A * 3/1996 Lu ..... A63B 60/00 473/332
6,299,547 B1 * 10/2001 Kosmatka ..... A63B 53/0466 473/345
7,914,393 B2 * 3/2011 Hirsch ..... A63B 53/0466 473/332
8,834,294 B1 * 9/2014 Seluga ..... A63B 53/04 473/345
9,067,110 B1 * 6/2015 Seluga ..... A63B 53/04
9,180,349 B1 * 11/2015 Seluga ..... A63B 53/0466
9,308,423 B1 * 4/2016 Tang ..... A63B 53/0466
9,486,677 B1 * 11/2016 Seluga ..... A63B 53/0466
9,597,558 B1 * 3/2017 Seluga ..... A63B 53/0466
9,597,561 B1 * 3/2017 Seluga ..... A63B 60/52
9,687,702 B1 * 6/2017 Seluga ..... A63B 53/0466
(Continued)

*Primary Examiner* — William M Pierce
(74) *Attorney, Agent, or Firm* — Michael A. Catania

(57) ABSTRACT

A golf club head comprising a body and a hollow stiffening structure is disclosed herein. The body comprises a face section, a sole section, and a crown section, and defines a hollow interior. The hollow stiffening structure extends within the hollow interior from the crown section to the sole section to reduce stresses placed on the face section during impact with a golf ball. The hollow stiffening structure creates stiffness in a vertical, crown-sole direction of the body, while reducing stiffness in the horizontal, front-rear direction. These two effects combine to increase ball speed and improve other performance metrics from low center through high center ball impact locations, and simultaneously lower CT of the golf club.

6 Claims, 9 Drawing Sheets

(56) References Cited

U.S. PATENT DOCUMENTS

| | | | | |
|---|---|---|---|---|
| 9,694,257 | B1 * | 7/2017 | Seluga | A63B 60/00 |
| 9,757,629 | B2 * | 9/2017 | Seluga | A63B 53/0466 |
| 9,776,058 | B2 * | 10/2017 | Seluga | A63B 53/04 |
| 9,814,947 | B1 * | 11/2017 | Seluga | A63B 53/0466 |
| 9,814,954 | B2 * | 11/2017 | Westrum | A63B 53/04 |
| 10,238,933 | B1 * | 3/2019 | Seluga | A63B 60/00 |
| 10,258,846 | B1 * | 4/2019 | Nunez | A63B 53/0466 |
| 10,369,435 | B1 * | 8/2019 | Myers | F16G 11/12 |
| 10,661,136 | B2 * | 5/2020 | Onuki | A63B 60/50 |
| 2016/0166893 | A1 * | 6/2016 | Akiyama | A63B 53/04 473/335 |
| 2019/0232129 | A1 * | 8/2019 | Nunez | A63B 53/0408 |

* cited by examiner

GOLF CLUB HEAD WITH HOLLOW STRESS-REDUCING FEATURES

CROSS REFERENCES TO RELATED APPLICATIONS

The present application is a continuation application of U.S. patent application Ser. No. 17/475,185, filed on Sep. 14, 2021, which claims priority to U.S. Provisional Patent Application No. 63/232,595, filed on Aug. 12, 2021, the disclosure of each which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head with an internal, hollow stiffening structure connecting a crown portion with a sole portion and disposed proximate a striking face section.

Description of the Related Art

The prior art discloses various golf club heads having interior structures. For example, Yabu, U.S. Pat. No. 6,852,038 for a Golf Club Head And Method Of Making The Same, discloses a golf club head with a sound bar, Galloway, U.S. Pat. No. 7,118,493 for a Multiple Material Golf Club Head discloses a golf club head with a composite aft body having an interior sound component extending upward from a sole section of a metal face component, Seluga et al., U.S. Pat. No. 8,834,294 for a Golf Club Head With Center Of Gravity Adjustability discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. Many of these prior art constructions include thickened sole features to add stiffness to the body in a front-to-back, horizontal direction, which can reduce ball speed and other performance metrics when a ball is hit at the edges of the face, most notably low and high center shots.

Geometric features that remove metal material from the sole of the golf club can increase ball speed for shots hit on the low center of the face. However, the additional movement of the club body during impact with a golf ball that is created by these features is undesirable, as these features can increase deformation of the body in the vertical direction, causing the body to move in the vertical direction during impact with a golf ball, which is also referred to as the body "wrapping around itself." This deformation negatively affects club performance, and can increase the characteristic time (CT) of the golf club head.

In order to improve shot performance on the perimeter of the face, a new geometry is needed to reduce the body stiffness in the horizontal direction, while still actively stiffening the club in the vertical, crown-sole direction.

BRIEF SUMMARY OF THE INVENTION

The golf club head comprises a hollow stiffening structure connecting a crown section to a sole section to reduce the stress in a striking face section, increase the stiffness of the body in a vertical direction, and reduce the body stiffness in a horizontal back to front direction, during impact with a golf ball.

One aspect of the present invention is a golf club head is a golf club head comprising a body comprising a face section with a face opening, a sole section extending from a lower edge of the face section, a return section extending from an upper edge of the face section, a hosel, a heel end, a toe end, an upper opening, a hollow interior, and an aft end, a face insert affixed to the body within the face opening, a crown insert affixed to the body and closing the upper opening, and a hollow stiffening structure extending from the sole section to the return section within the hollow interior, the hollow stiffening structure comprising at least one interior wall that is suspended within the hollow interior of the body, wherein the hollow stiffening structure does not make contact with any portion of the face section or the face insert, wherein the hollow stiffening structure is entirely disposed within 1 inch of a rear surface of the face insert measured along a vertical, front to back plane extending through a geometric center of the face insert, and wherein no openings are disposed within the interior wall, such that an interior of the hollow stiffening structure does not communicate with the hollow interior of the body.

In some embodiments, the return section may comprise an elongated upper opening, the sole section may comprise an elongated lower opening, an upper end of the hollow stiffening structure may be disposed within the elongated upper opening, and a lower end of the hollow stiffening structure may be disposed within the elongated lower opening. In a further embodiment, the upper end of the hollow stiffening structure may comprise an upper opening in communication with an exterior of the golf club head, and the lower end of the hollow stiffening structure may comprise a lower opening in communication with the exterior of the golf club head. In another, further embodiment, the hollow stiffening structure may comprise a heel side connector, a toe side connector, an upper connector, and a lower connector encircling at least one opening. In a further embodiment, the hollow stiffening structure may further comprise at least one central connector extending between the upper connector and the lower connector and dividing the at least one opening into a plurality of openings.

In other embodiments, the hollow stiffening structure may have a rectangular shape, or may have a depth of 0.030 to 0.300 inch. In another embodiment, the golf club head may be a fairway wood-type golf club head, the body may be composed of a metal alloy, the face insert may be composed of a metal alloy, and the crown insert may be composed of a composite material. In a further embodiment, the hollow stiffening structure is composed of a metal alloy, or it may be composed of a non-metal material selected from the group consisting of plastic and carbon composite. In any embodiment, the hollow stiffening structure may have a mass of less than 10 grams.

Another aspect of the present invention is a golf club head comprising a body comprising a face section with a face opening, a sole section extending from a lower edge of the face section, a return section extending from an upper edge of the face section, a hosel, a heel end, a toe end, an upper opening, a hollow interior, and an aft end, a face insert affixed to the body within the face opening, a crown insert affixed to the body and closing the upper opening, a hollow stiffening structure extending from the sole section to the return section within the hollow interior, and a weight, wherein the hollow stiffening structure is entirely disposed within 1 inch of a rear surface of the face insert measured along a vertical, front to back plane extending through a geometric center of the face insert, wherein the hollow stiffening structure does not make contact with any portion of the face section or the face insert, wherein the sole section comprises an elongated lower opening, wherein a lower end of the hollow stiffening structure is disposed within the elongated lower opening, wherein the lower end of the hollow stiffening structure comprises a lower opening in communication with the exterior of the golf club head, and wherein the weight is disposed within the lower end of the hollow stiffening structure.

In some embodiments, the golf club head may further comprise a polymer adhesive, which may fix the weight within the lower end of the hollow stiffening structure. In another embodiment, the weight may comprise a material selected from the group consisting of tungsten and steel. In a further embodiment, the golf club head may comprise an elongated washer with a through-opening and an end portion and a retention screw with a head portion and a threaded extension portion. In this embodiment, the sole may comprise a port disposed proximate the lower opening, the threaded extension portion may extend through the through-opening to engage the port, and fully engaging the retention screw within the port may fix the washer to the sole so that the end portion of the elongated washer extends over the lower opening to trap the weight within the lower end of the hollow stiffening structure.

In another embodiment, the golf club head may further comprise a retention screw with a head portion and a threaded extension portion. In this embodiment, the sole may comprise an angled port disposed proximate the lower opening, the port may communicate with and extend into an opening in the lower connector, and fully engaging the retention screw within the port may cause the threaded extension portion to press against the weight and secure it within the lower end of the hollow stiffening structure. In a further embodiment, the weight may comprise an indentation sized to receive a portion of the threaded extension portion.

In any of the embodiments, the hollow stiffening structure may comprise a heel side connector, a toe side connector, an upper connector, and a lower connector encircling at least one opening. In another embodiment, the hollow stiffening structure may have a rectangular shape, and may also have a depth of 0.030 to 0.300 inch.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
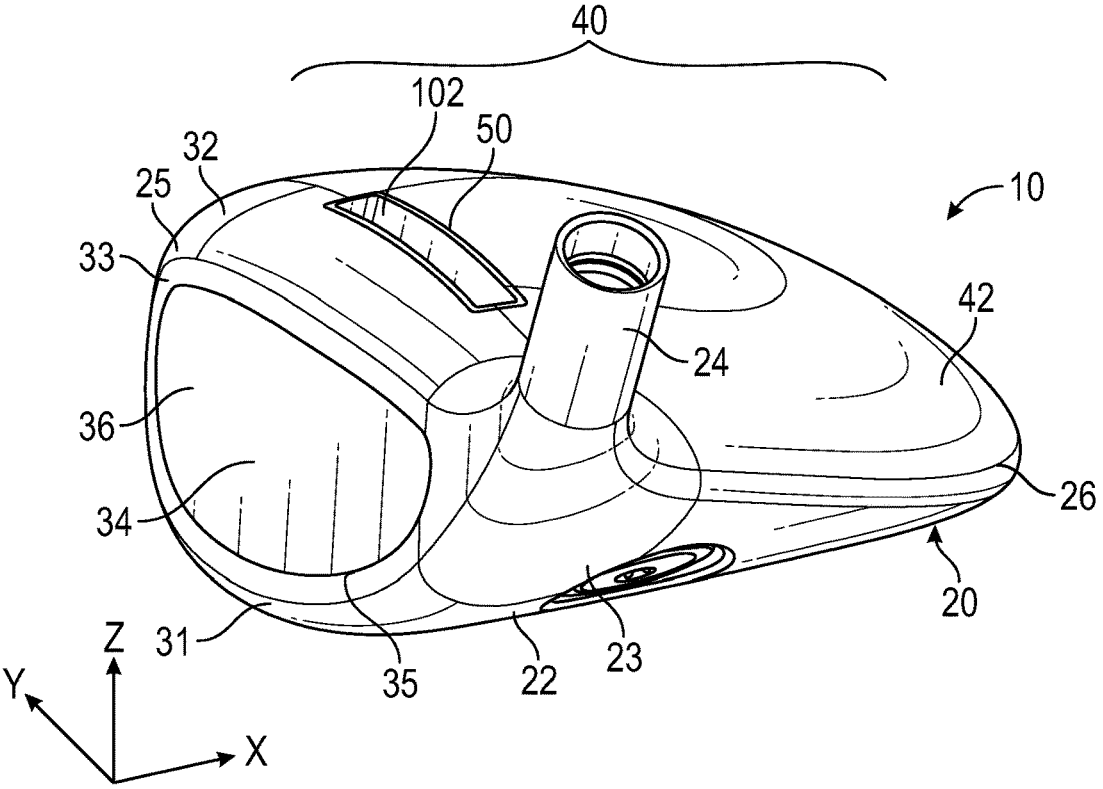
FIG. 1 is a side perspective view of a first embodiment of the golf club head of the present invention.
Figure 2:
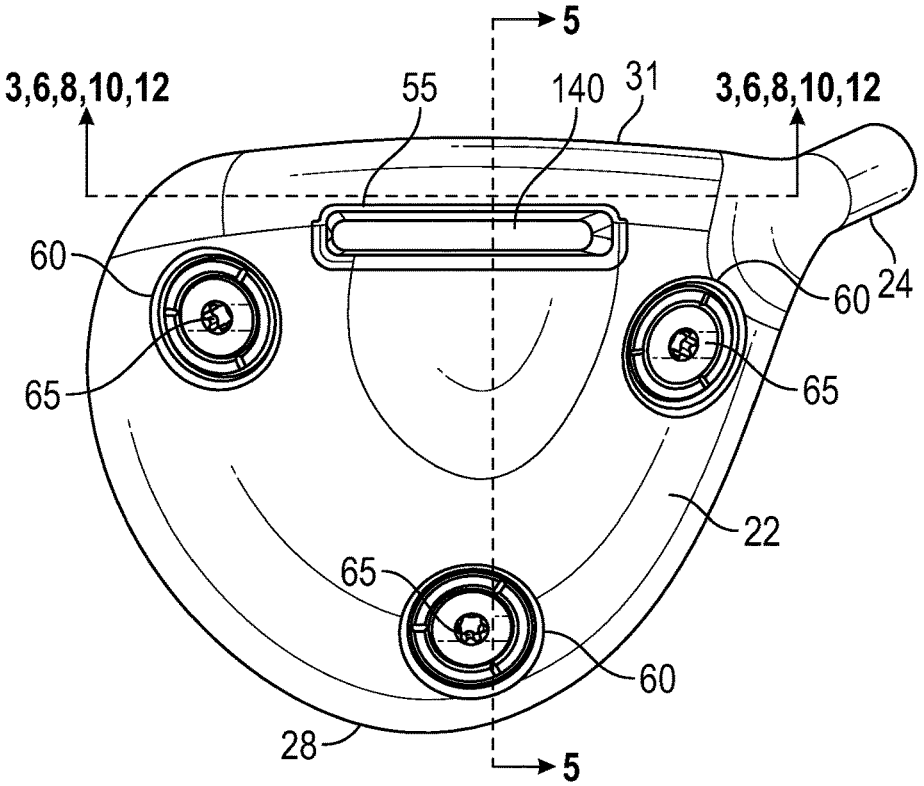
FIG. 2 is a bottom plan view of the embodiment shown in FIG. 1.
Figure 3:
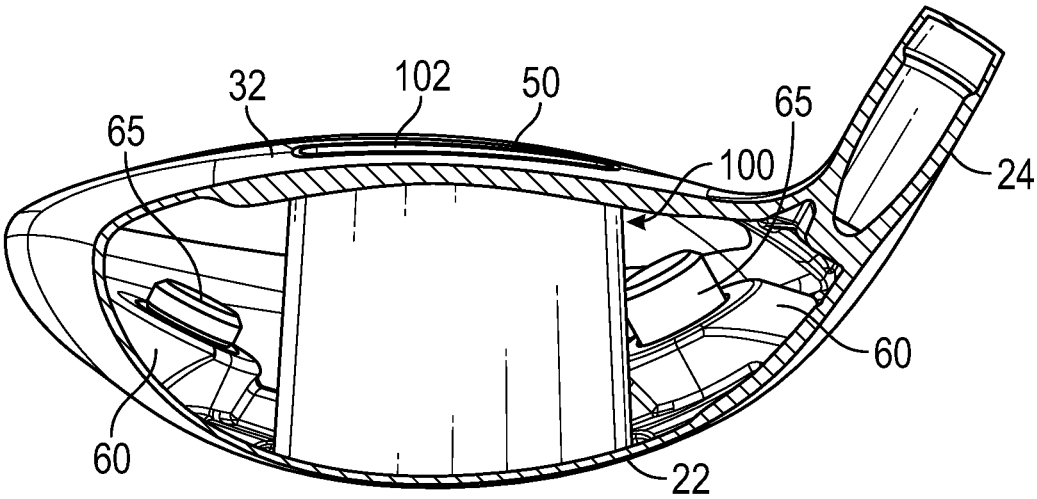
FIG. 3 is a cross-sectional view of the golf club head shown in FIG. 2 taken along lines 3-3.
Figure 4:
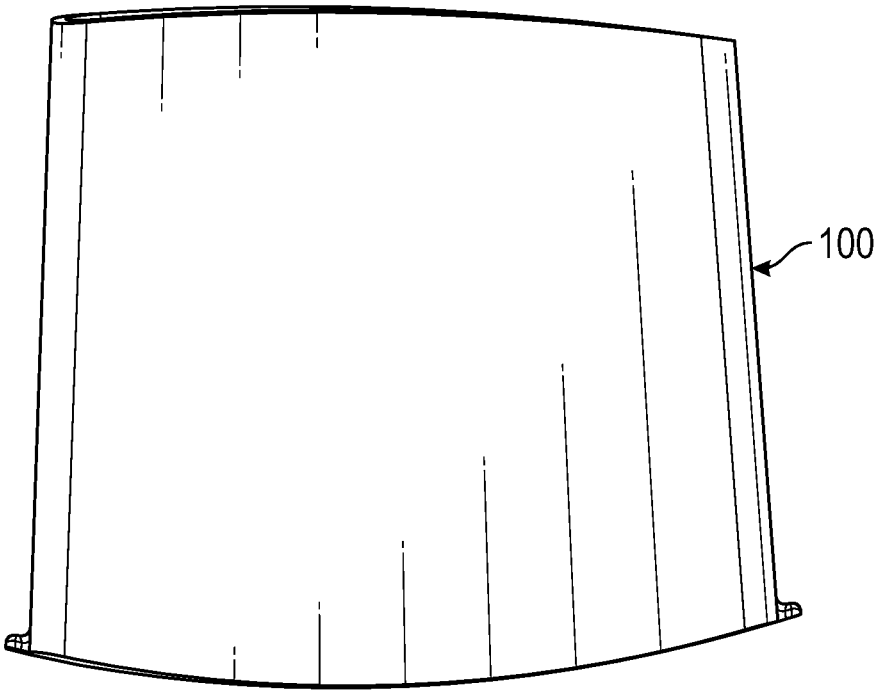
FIG. 4 is a front elevational view of the hollow stiffening member shown in FIG. 3.

A first embodiment of the present invention is shown in FIGS. 1-5. The golf club head 10 includes a body 20 having a face section 30, a sole section 22 extending from a lower edge 31 of the face section 30, a return section 32 extending away from an upper edge 33 of the face section 30, a hosel 24 for engaging a shaft, a heel end 23, a toe end 25, an upper opening 26, a hollow interior 27, and an aft end 28. The face section 30 includes an opening 35 into which a face insert 36 is welded. A crown section 40 is comprised of the return section 32 and a crown insert 42 that is placed over the upper opening 26, and permanently affixed to the body 20, to enclose the hollow interior 27. An upper elongated opening 50 is disposed within the return section 32, extending in a heel to toe direction, and a lower elongated opening 55 is disposed within the sole section 22 beneath and aligned with the upper elongated opening 50. The sole section 22 also comprises a plurality of weight ports 60 sized to receive one or more weight screws 65.

Within the hollow interior 27, a hollow stiffening structure 100 extends from the lower elongated opening 55 in the sole section 22 upward to the upper elongated opening 50 in the return section 32. In an alternative embodiment, the hollow stiffening structure 100 may extend to the crown insert 42 instead, and in another, alternative embodiment, the body 20 may lack an upper opening 26 entirely and the crown section 40 may extend from the upper edge 33 of the striking face section all the way to the aft end 28; what is important is that, as shown in FIGS. 1-3 and 5, the stiffening structure 100 connects the crown section 40 to the sole section 22 in close proximity to the rear surface 37 of the face section 30 without making contact with any portion of the face section 30, including the rear surface 37, even during impact with a golf ball. The upper and lower openings 102, 104 of the hollow stiffening structure 100, which fit within the upper and lower elongated openings 50, 55 in the body 20, are open to the exterior of the golf club head 10, and can be covered with a cap or filled with a weighted and/or elastomeric material, as further illustrated herein. There are no openings between the hollow stiffening structure 100 and the hollow interior of the body 20, which prevents any debris that might enter the hollow stiffening structure 100 from finding its way into the rest of the golf club head 10.

Figure 6:
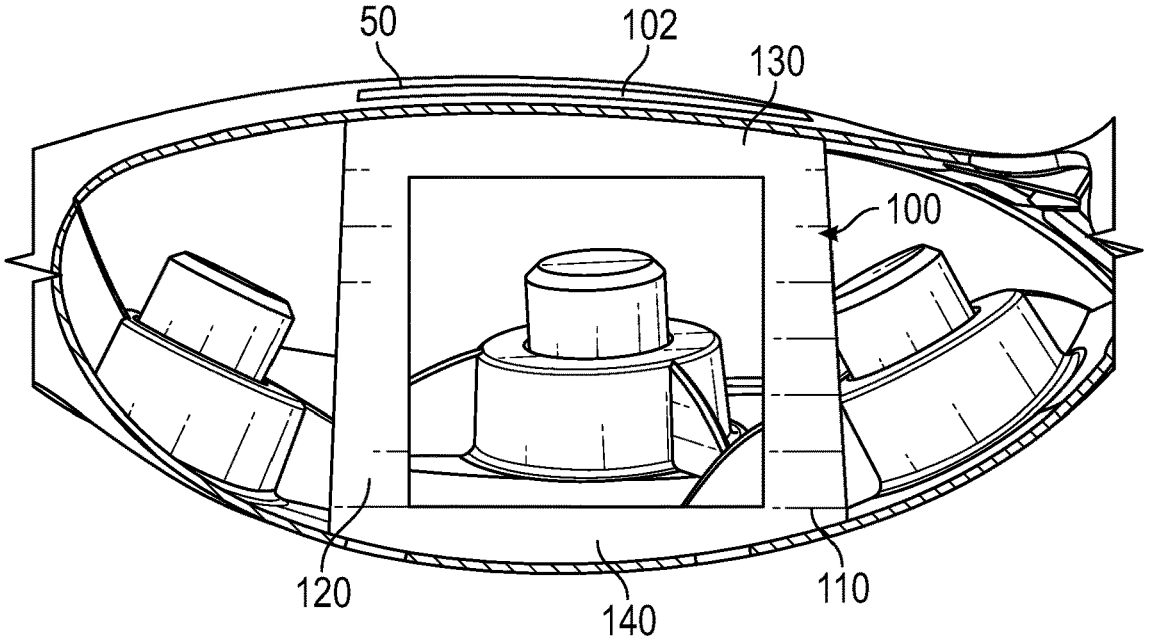
FIG. 6 is a cross-sectional view of the golf club head shown in FIG. 2 taken along lines 6-6 with a second, alternative embodiment of the stiffening structure of the present invention.
Figure 7:
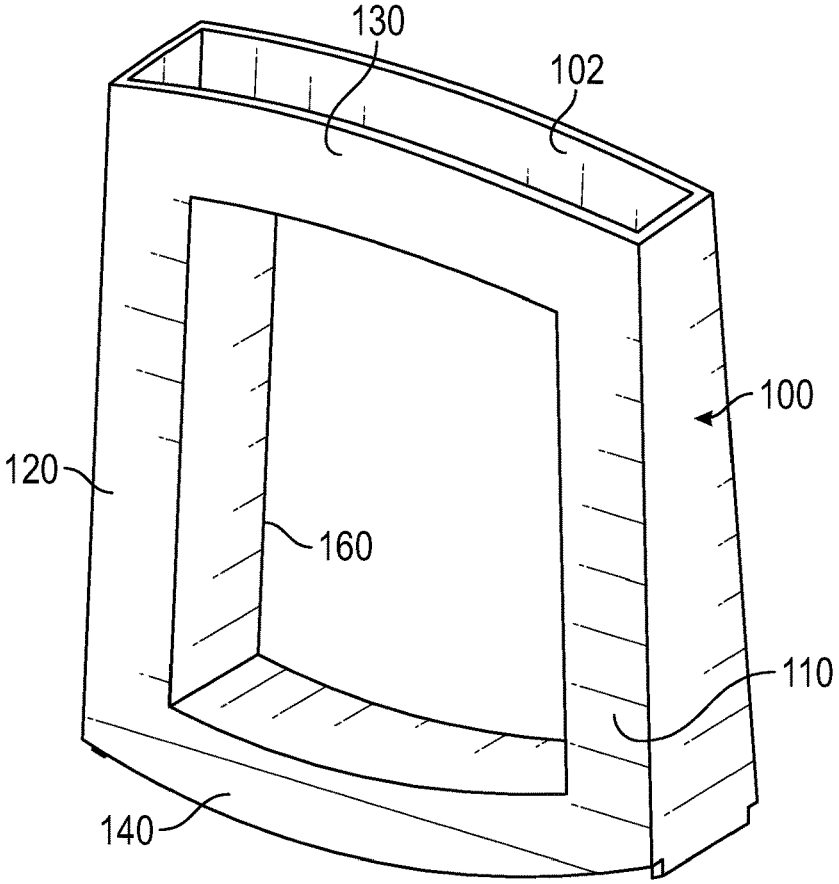
FIG. 7 is a side perspective view of the hollow stiffening member shown in FIG. 6.

In a second embodiment of the present invention, shown in FIGS. 6-7, the golf club head 10 has the same features as the first embodiment, except that the hollow stiffening structure 100 of the present invention comprises a heel side connector 110 extending between the return section 32 and the sole section 22 proximate the heel end 23, a toe side connector 120 extending between the return section 32 and the sole section 22 proximate the toe end 25, an upper connector 130 extending between, and connecting, the heel side connector 110 and the toe side connector 120 and in communication with the upper opening 102, and a lower connector 140 extending between, and connecting, the heel side connector 110 and the toe side connector 120 and in communication with the lower opening 104. The hollow stiffening structure 100 of the second embodiment has an overall square or rectangular shape, with an opening 160 that is effectively encircled by the connectors 110, 120, 130, 140, though in alternative embodiments it may have a different geometry.

Figure 8:
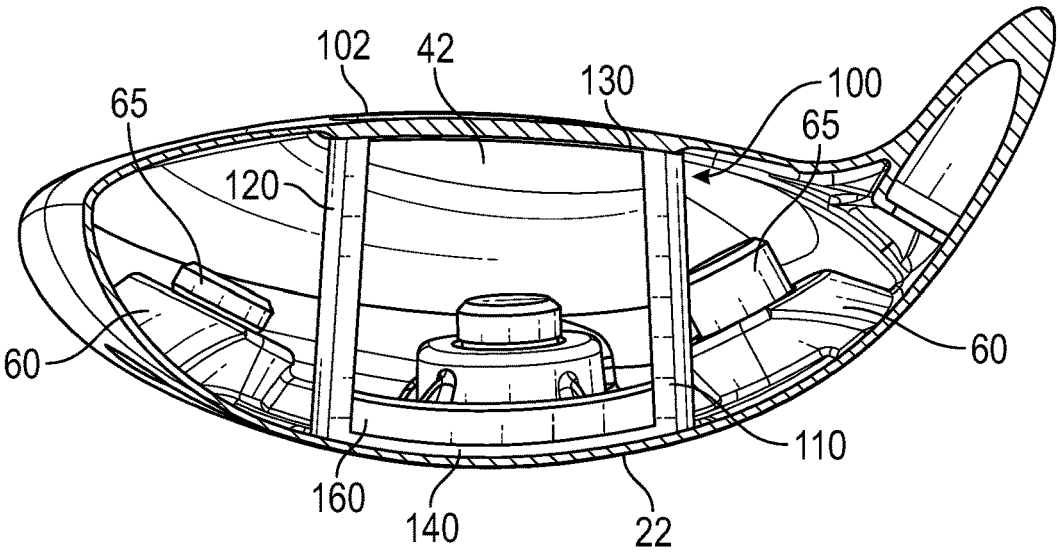
FIG. 8 is a cross-sectional view of the golf club head shown in FIG. 2 along lines 8-8 with a third, alternative embodiment of the stiffening structure of the present invention.
Figure 9:
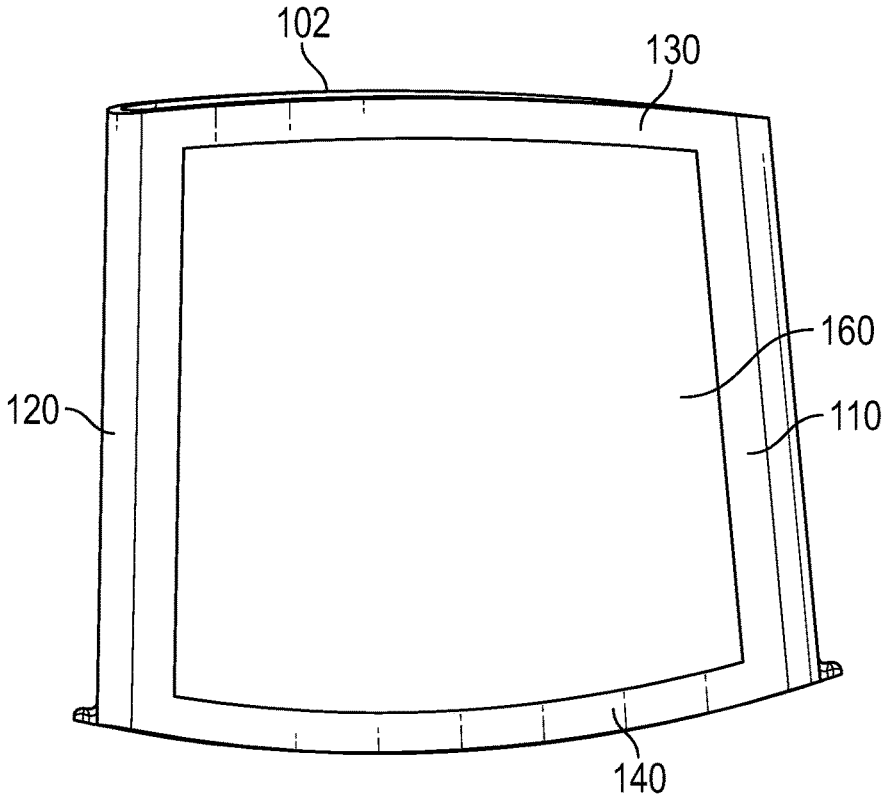
FIG. 9 is a front elevational view of the hollow stiffening member shown in FIG. 8.

In a third, preferred embodiment, shown in FIGS. 8-9, the golf club head 10 has all of the same features as the second embodiment, except that the connectors 110, 120, 130, 140 of the hollow stiffening structure 100 are narrower and the rectangular opening 160 is larger, thereby freeing up discretionary mass and reducing the overall mass of the hollow stiffening structure 100.

Figure 10:
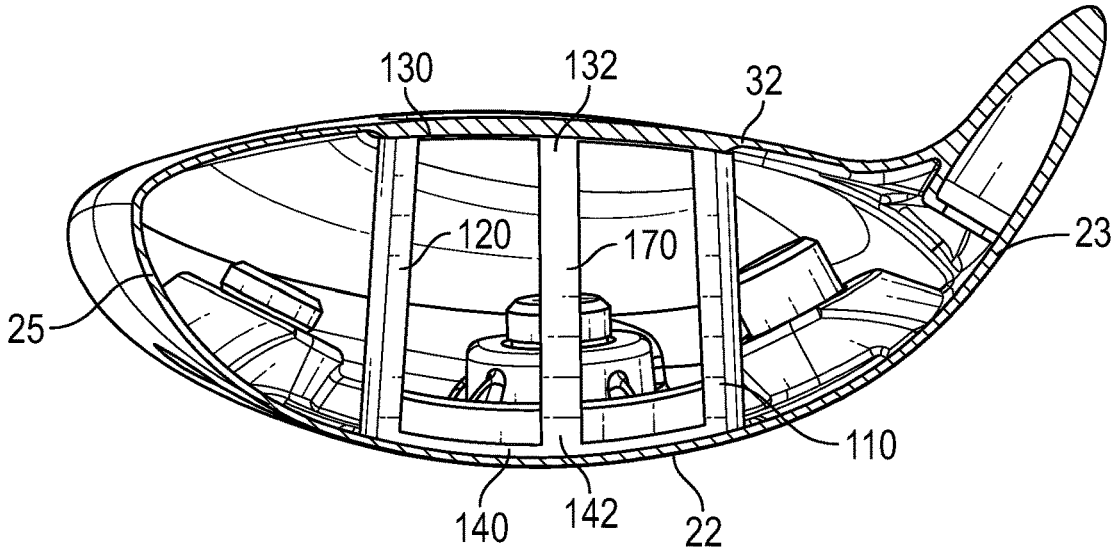
FIG. 10 is a cross-sectional view of the golf club head shown in FIG. 2 along lines 10-10 with a fourth, alternative embodiment of the stiffening structure of the present invention.
Figure 11:
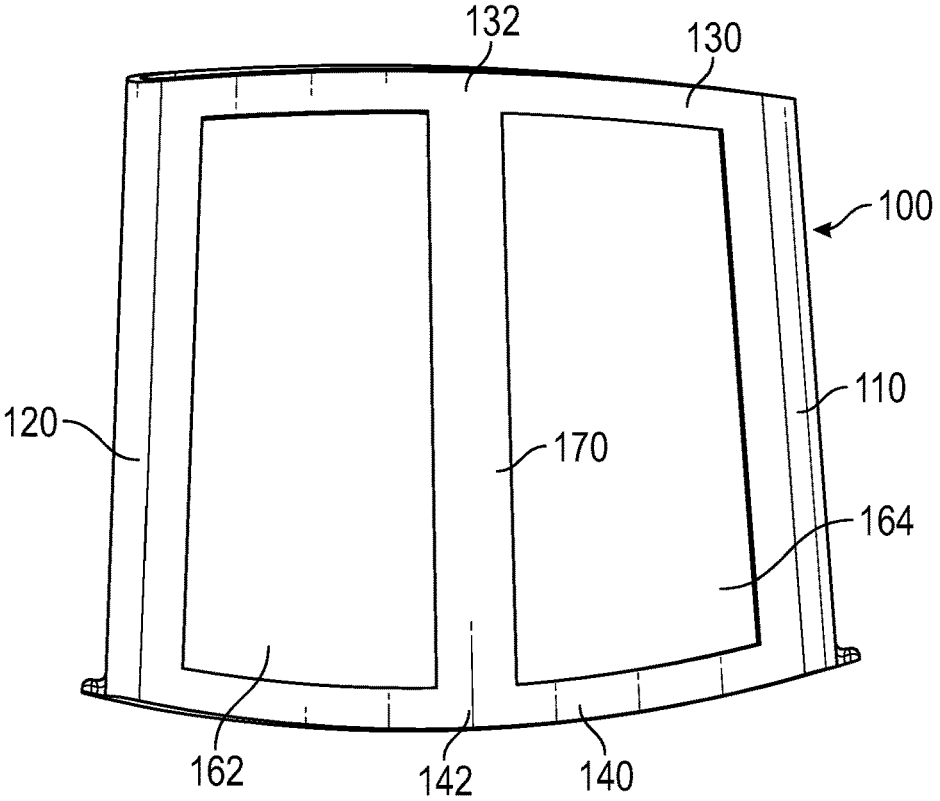
FIG. 11 is a front elevational view of the hollow stiffening member shown in FIG. 10.
Figure 12:
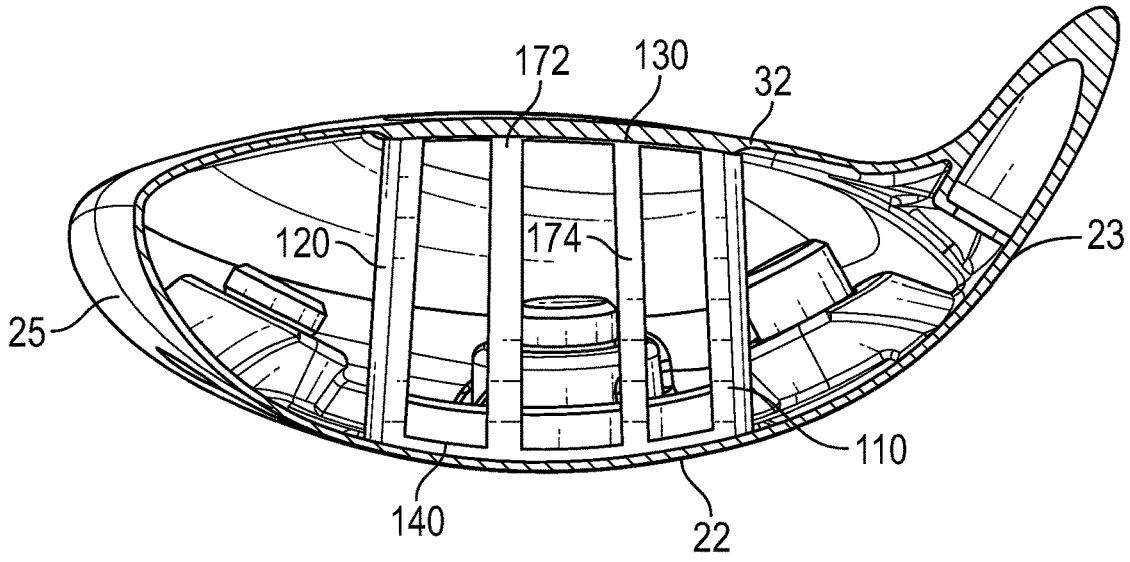
FIG. 12 is a cross-sectional view of the golf club head shown in FIG. 2 along lines 12-12 with a fifth, alternative embodiment of the stiffening structure of the present invention.
Figure 13:
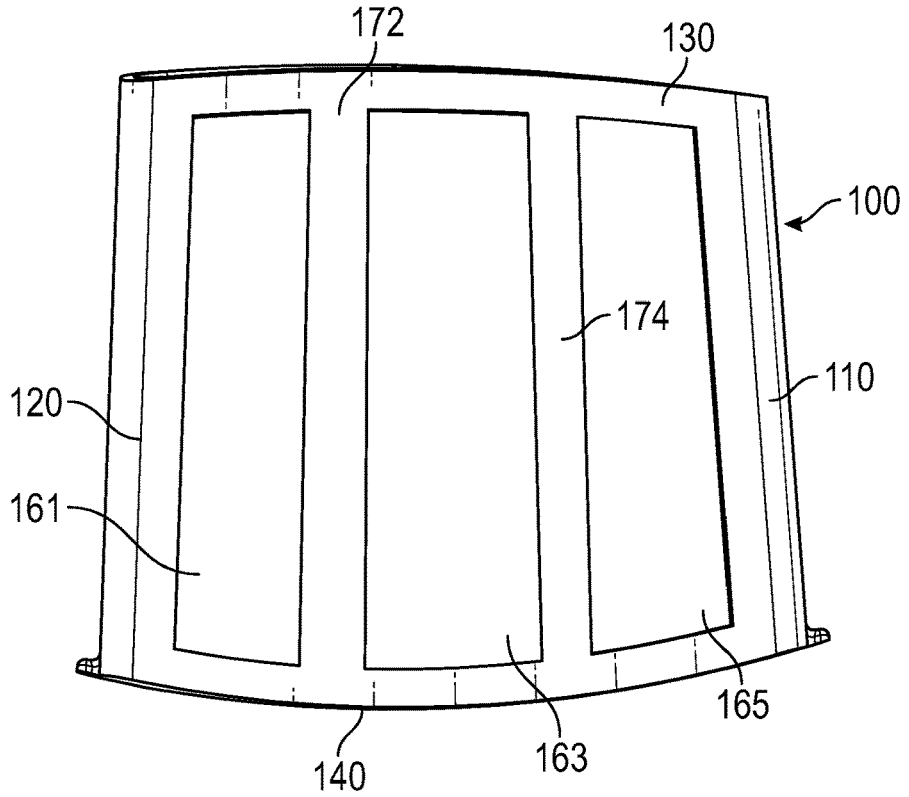
FIG. 13 is a front elevational view of the hollow stiffening member shown in FIG. 12.

In a fourth embodiment, shown in FIGS. 10-11, the golf club head 10 has the same features as the third embodiment, except that the hollow stiffening structure 100 has a central connector 170 extending between the upper and lower connectors 130, 140 at their midpoints 132, 142, and dividing the opening 160 into two sections 162, 164. In a fifth embodiment, shown in FIGS. 12-13, the golf club head 10 has the same features as the third embodiment, except that the hollow stiffening structure 100 has two central connectors 172, 174 spaced between the heel and toe connectors to divide the opening 160 into three sections 161, 163, 165.

Figure 14:
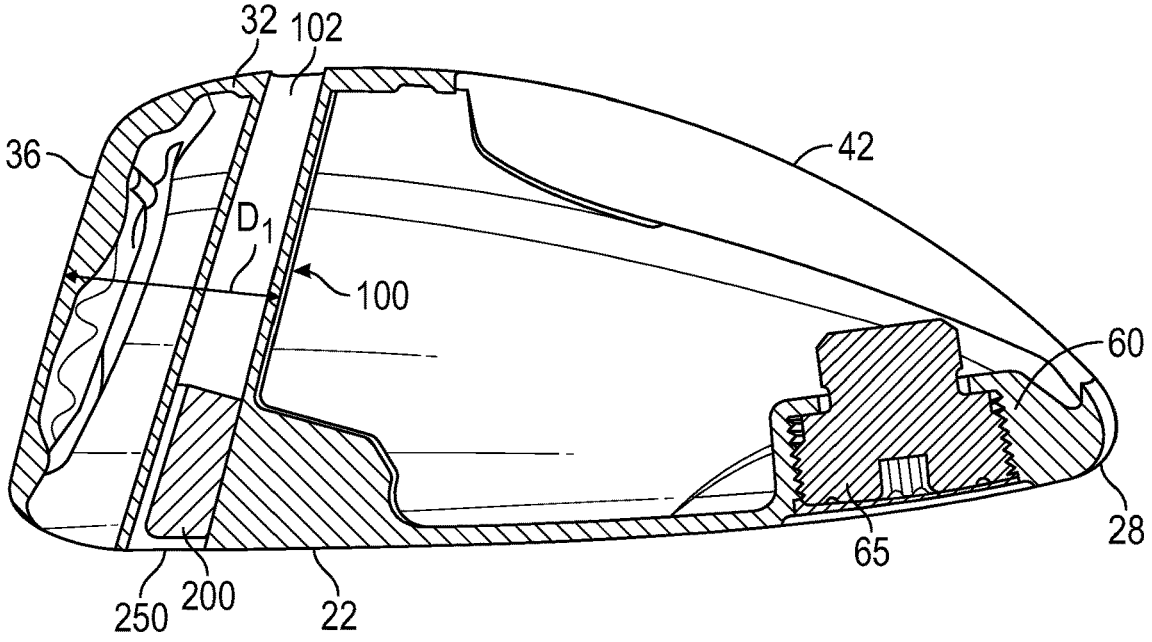
FIG. 14 is a cross-sectional view of the golf club head shown in FIG. 2 taken along lines 14-14 with a sixth, alternative embodiment of the stiffening structure of the present invention.

In a sixth embodiment, shown in FIG. 14, the golf club head 10 has all of the same features as the first embodiment, with the addition of a tungsten or steel weight 200 affixed within the lower connector 140 with a polymer adhesive 250, a portion of which is visible through the lower opening 104. As shown in Tables I and II below, this configuration increases ball speed low on the face, reduces backspin by lowering the center of gravity (CG) height, improves spin robustness in the vertical direction utilizing higher moment of inertia Iyy and shallower CG depth, allows for customization of CG height and bias, and seals off the lower portion of the hollow stiffening structure 100 so that debris does not enter the golf club head 10 during use.

TABLE I

| Impact Frame Mass Properties (Empty Stiffening Structure 100) | | | |
|---|---|---|---|
| Cg(x), Cg(y), Cg(z) | 1.175 | −0.015 | 0.284 |
| I(xx), I(yy) I(zz) | 1876 | 1264 | 2661 |
| I(xy), I(xz), I(yz) | 133 | 103 | −69 |

TABLE II

| Impact Frame Mass Properties (Tungsten in Stiffening Structure 100) | | | |
|---|---|---|---|
| Cg(x), Cg(y), Cg(z) | 0.996 | −0.017 | 0.110 |
| I(xx), I(yy) I(zz) | 1267 | 1368 | 2005 |
| I(xy), I(xz), I(yz) | 152 | 176 | −70 |

Figure 15:
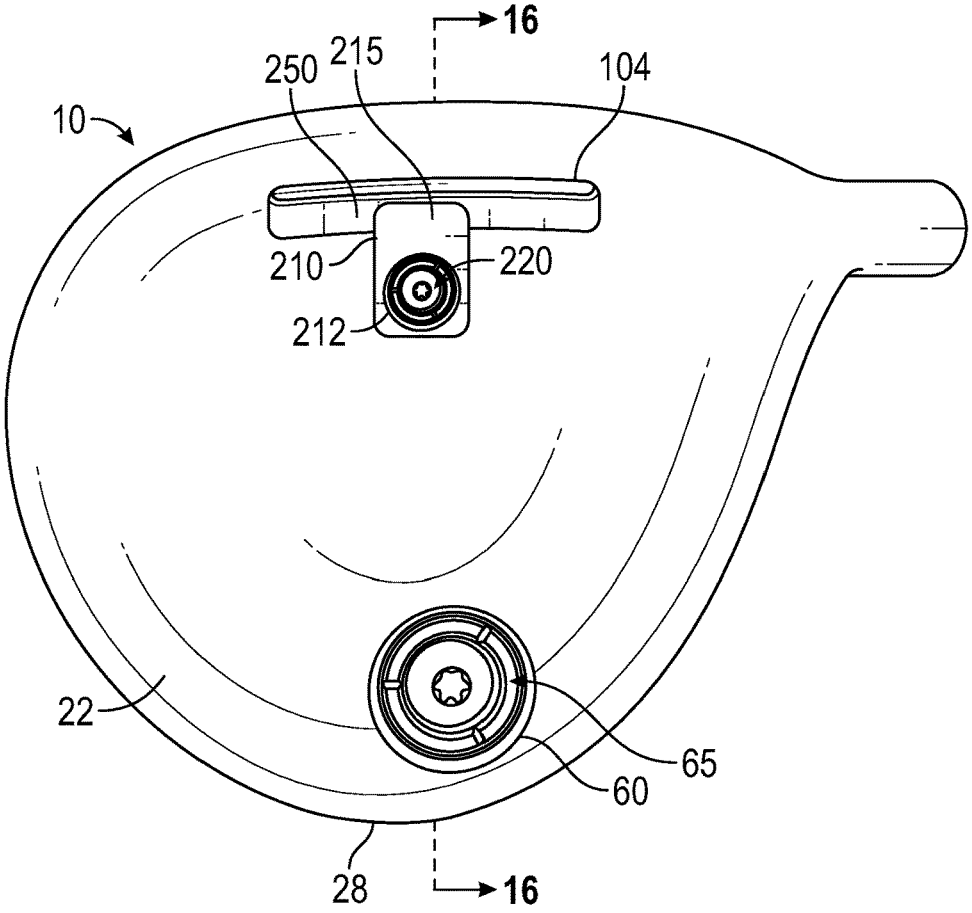
FIG. 15 is a sole plan view of a seventh embodiment of the golf club head of the present invention.
Figure 16:
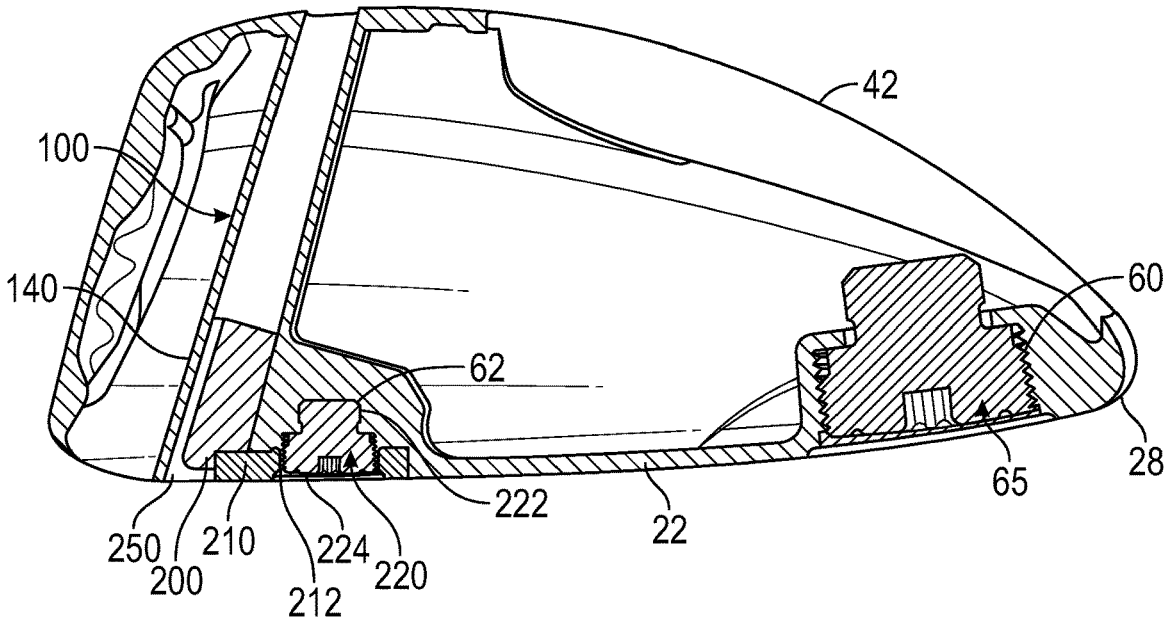
FIG. 16 is a cross-sectional view of the golf club head shown in FIG. 15 taken along lines 16-16.

In a seventh embodiment, shown in FIGS. 15 and 16, the golf club head 10 has all of the same features as the sixth embodiment, except that the weight 200 is further secured within the lower connector 140 mechanically with a washer 210 and a retention screw 220. The washer 210 is elongated so that, when it is properly engaged with the sole 22, an end portion 215 of the washer 210 extends over the lower opening 104 and has a through-opening 212 sized to receive the threaded extension portion 222, but not the head 224, of the screw 220. The threaded extension portion 222 is inserted through the through-opening 212 and is screwed into a port 62 disposed proximate the lower opening 104 in the sole 22.

Figure 17:
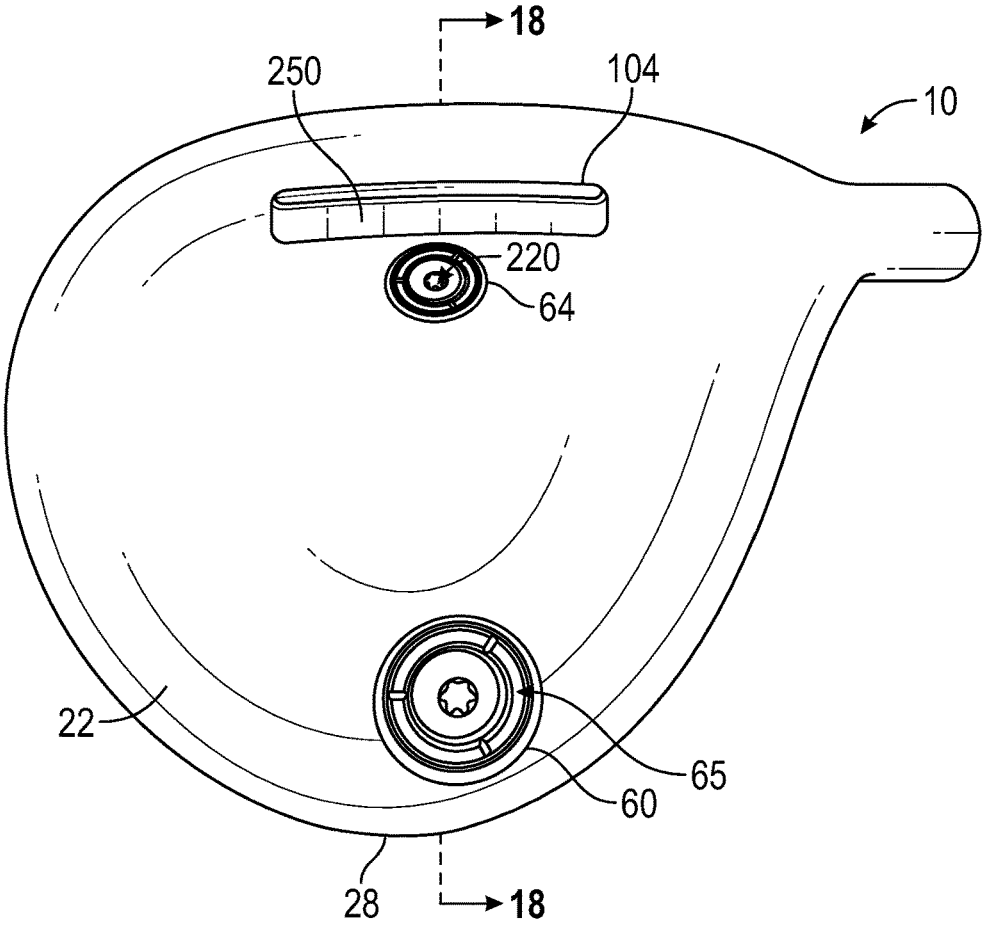
FIG. 17 is a sole plan view of an eighth embodiment of the golf club head of the present invention.
Figure 18:
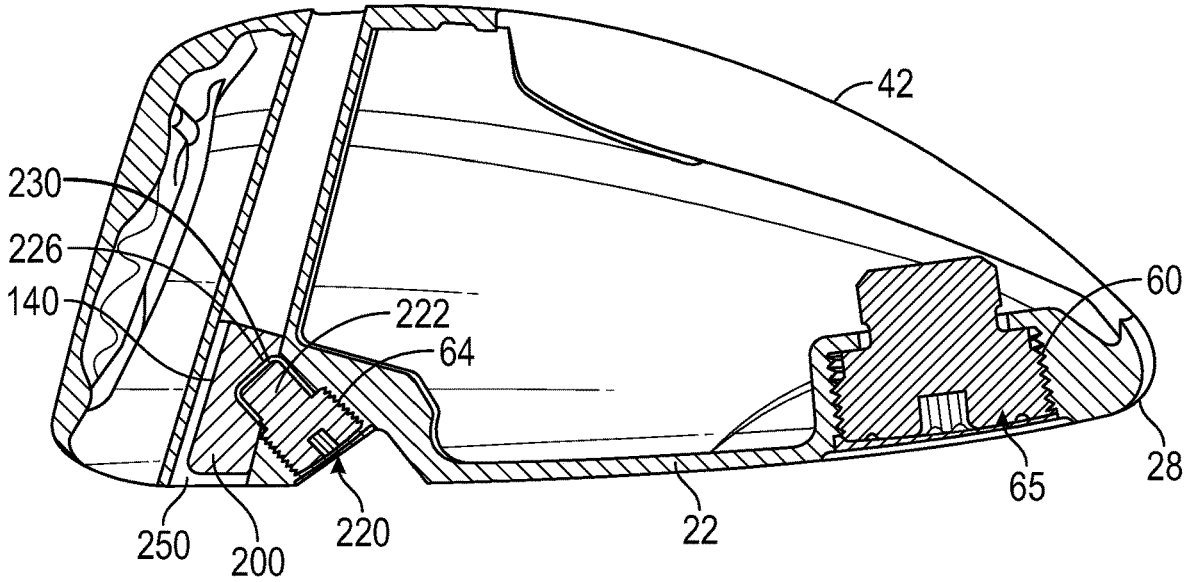
FIG. 18 is a cross-sectional view of the golf club head shown in FIG. 17 taken along lines 18-18.

In an eighth embodiment, shown in FIGS. 17 and 18, the golf club head 10 has all of the same features as the sixth embodiment, except that the weight 200 is further secured within the lower connector 140 mechanically with a retention screw 220 that is inserted into an angled port 64 disposed proximate the lower opening 104 in the sole 22. The port 64 preferably communicates with and extends into an opening 230 in the lower connector 140 so that the threaded extension portion 222 of the retention screw 220 can extend into the lower connector 140. The weight 220 includes an indentation 226 sized to receive a portion of the threaded extension portion 222, which when fully engaged with the port 64 places pressure on the weight 220 within the lower connector 140.

Figure 5:
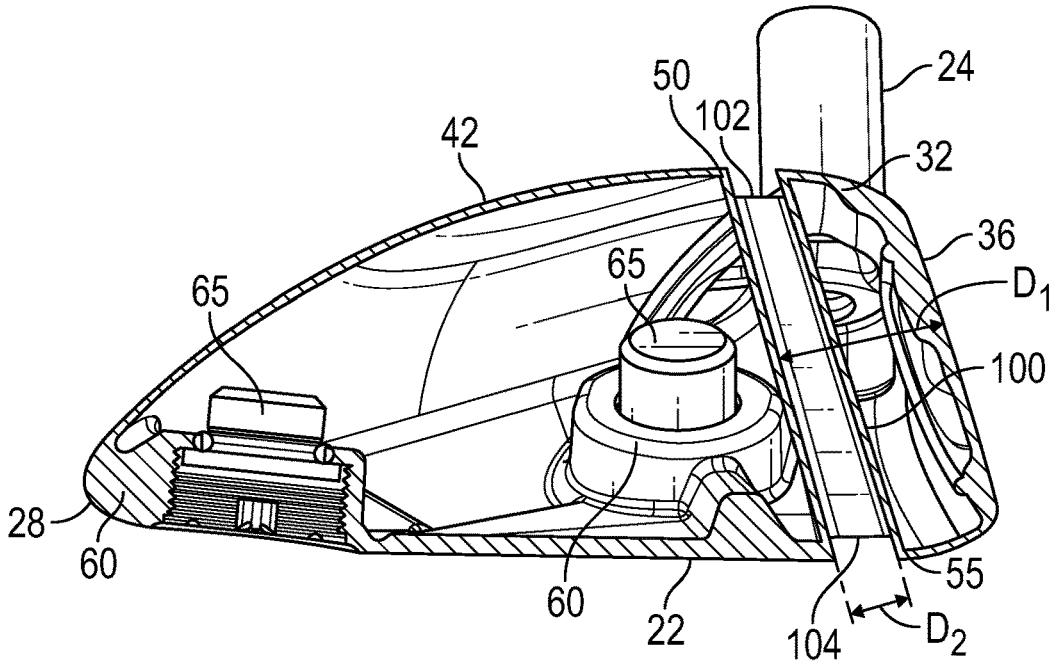
FIG. 5 is a cross-sectional view of the golf club head shown in FIG. 2 taken along lines 5-5.

As shown in FIGS. 5 and 14, in each of the embodiments disclosed herein, the entirety of the hollow stiffening structure 100 is located a depth $D_1$ of less than 1 inch from the rear surface 36 of the face section 30, measured along a vertical plane extending along the vertical Z-axis and horizontal X-axis extending through the face center 34 perpendicular to the face section 30. No portion of the hollow stiffening structure 100 should be disposed outside of this 1 inch range. Locating the stiffening structure 100 in this way has the greatest stress-reducing effect on the golf club head 10, and allows the thickness of the striking face section 30 to be reduced, thus freeing up discretionary mass. If any portion of the hollow stiffening structure 100 is placed more than 1 inch away from the rear surface 36 of the face section 30, it will not have a noticeable effect on the stress placed on the face section 30 when the golf club head 10 is in use, and will use up mass without creating a significant performance benefit. Furthermore, the hollow stiffening structure 100 in any of these embodiments has a y-axis depth $D_2$ that ranges from 0.030 to 0.300 inch.

The golf club head of the present invention has improved performance characteristics when a golf ball is hit on the low center of the face compared with prior art clubs that lack the features disclosed herein. The structure allows for this improvement without significantly reducing performance of the golf club for shots hit in the center of the face, and without increasing CT of the golf club head. The structure has a secondary benefit of increasing some performance metrics for high center shots as well. While the preferred embodiment of the structure is shown herein in connection with a fairway wood-type golf club head with a mass of 135 grams to 250 grams, and preferably from 140 grams to 165 grams, it may also be incorporated into driver, hybrid, iron, and putter type golf club heads.

The hollow stiffening structure 100 of the present invention works in three ways. First, the hollow stiffening structure 100 reduces the stiffness of the club body 20 in the horizontal, front-to-back x-axis direction close to the face section 30 in areas on the sole 22 and crown 40 of the golf club. This allows for higher ball speed and improved metrics for shots hit on the low center and high center of the face insert 36. Second, the hollow stiffening structure 100 increases stiffness of the club body in the z-axis (vertical) direction, which allows for increased ball speed for a majority of impact locations on the face insert 36, and simultaneously reduces CT of the golf club 10. This vertical stiffening effect also constrains the edges of the horizontally reduced stiffness areas, preventing the body from wrapping around itself. Third, the hollow stiffening structure 100 reduces stress in the center and low center areas of the face insert 36, allowing for the center and low center of the face insert 36 to be made thinner without exceeding stress constraints, which allows for additional increases in shot performance.

The hollow stiffening structure 100 may be composed of any strong material, but preferably is composed of the same material as that of the body 20 of the golf club head 10, which may be steel or titanium alloy. In other embodiments, the structure 100 may be made of a different material from the body 20, and in particular non-metal materials such as plastic or carbon composite. In any event, it is critical that the stiffening structure 100 have an overall mass of less than 10 grams, and more preferably less than 8 grams, in order to conserve discretionary mass and avoid undesirable changes to the mass properties (such as center of gravity location) of the golf club head 10.

In each of the embodiments disclosed herein, the golf club head 10 preferably has a Characteristic Time (CT) of the face close to, but not exceeding, the 257 microsecond ("μS") limit set by the USGA. In each of the embodiments disclosed herein, the face insert 36 preferably has a varying thickness such as that described in U.S. Pat. No. 7,448,960, for a Golf Club Head With Variable Face Thickness, which pertinent parts are hereby incorporated by reference. Other alternative embodiments of the thickness of the face insert 36 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the face insert 36 may have a uniform thickness.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a face section with a face opening, a sole section extending from a lower edge of the face section, a return section extending from an upper edge of the face section, a hosel, a heel end, a toe end, an upper opening, a hollow interior, and an aft end;

a face insert affixed to the body within the face opening;

a crown insert affixed to the body and closing the upper opening;

a hollow stiffening structure extending from the sole section to the return section within the hollow interior; and a weight, wherein the hollow stiffening structure is entirely disposed within 1 inch of a rear surface of the face insert measured along a vertical, front to back plane extending through a geometric center of the face insert, wherein the hollow stiffening structure does not make contact with any portion of the face section or the face insert, wherein the sole section comprises an elongated lower opening, wherein a lower end of the hollow stiffening structure is disposed within the elongated lower opening, wherein the hollow stiffening structure has a rectangular cross-sectional shape, and a depth, characterized as the width in a direction from the face section to the aft end, D2, ranging from 0.03 to 0.3 inch;

wherein the lower end of the hollow stiffening structure comprises a lower opening in communication with the exterior of the golf club head, and wherein the weight is disposed within the lower end of the hollow stiffening structure.

2. The golf club head of claim 1, further comprising a polymer adhesive, wherein the polymer adhesive fixes the weight within the lower end of the hollow stiffening structure.

3. The golf club head of claim 2, wherein the weight comprises a material selected from the group consisting of tungsten and steel.

4. The golf club head of claim 1, further comprising:

an elongated washer with a through-opening and an end portion; and a retention screw with a head portion and a threaded extension portion, wherein the sole comprises a port disposed proximate the lower opening, wherein the threaded extension portion extends through the through-opening to engage the port, and wherein fully engaging the retention screw within the port fixes the washer to the sole so that the end portion of the elongated washer extends over the lower opening to trap the weight within the lower end of the hollow stiffening structure.

5. The golf club head of claim 1, further comprising a retention screw with a head portion and a threaded extension portion, wherein the sole comprises an angled port disposed proximate the lower opening, wherein the port communicates with and extends into an opening in the lower connector, wherein fully engaging the retention screw within the port causes the threaded extension portion to press against the weight and secure it within the lower end of the hollow stiffening structure.

6. The golf club head of claim 5, wherein the weight comprises an indentation sized to receive a portion of the threaded extension portion.

* * * * *